US012102252B2

(12) United States Patent
Liu

(10) Patent No.: US 12,102,252 B2
(45) Date of Patent: Oct. 1, 2024

(54) RETRACTABLE SHOWER CURTAIN ROD AND ITS EXTENDABLE INSTALLATION METHOD

(71) Applicant: Shine Home Products Co., Ltd., Dongguan (CN)

(72) Inventor: Huisheng Liu, Dongguan (CN)

( * ) Notice: Subject to any disclaimer, the term of this patent is extended or adjusted under 35 U.S.C. 154(b) by 0 days.

(21) Appl. No.: 18/299,312

(22) Filed: Apr. 12, 2023

(65) Prior Publication Data

US 2024/0156292 A1 May 16, 2024

(30) Foreign Application Priority Data

Jul. 12, 2022 (CN) ..... 202210822799.7

(51) Int. Cl.
*A47H 1/022* (2006.01)
*A47H 1/122* (2006.01)

(52) U.S. Cl.
CPC ..... *A47H 1/022* (2013.01); *A47H 1/122* (2013.01)

(58) Field of Classification Search
CPC ..... A47H 1/022; A47H 1/122; A47H 2001/0215; A47H 1/08; A47H 2001/042; A47K 3/38; A47G 25/0692; A47B 61/02; F16B 7/1418; F16B 7/1472
USPC ..... 211/105.3, 105.2, 105.4, 105.5
See application file for complete search history.

(56) References Cited

U.S. PATENT DOCUMENTS 2,263,698 A * 11/1941 Hodgson ..... B60R 21/02 410/151
4,733,681 A * 3/1988 Lee ..... A63B 47/02 D21/721
5,692,856 A * 12/1997 Newman, Jr. ..... B25G 1/04 403/109.5
6,045,188 A * 4/2000 Schooler ..... B60N 2/929 297/375
6,488,159 B2 * 12/2002 Shuen ..... A47G 25/0692 211/105.3
7,066,511 B2 * 6/2006 Newman ..... H01K 3/32 81/53.11
8,205,760 B2 * 6/2012 Chang ..... A47K 3/38 211/105.3
8,479,932 B2 * 7/2013 Carney ..... A47H 1/022 403/109.5
8,800,072 B2 * 8/2014 Chang ..... A47K 3/38 4/558
8,978,228 B2 * 3/2015 Didehvar ..... A47K 3/38 29/434
9,102,051 B2 * 8/2015 Chen ..... B25G 1/04
9,474,421 B2 * 10/2016 Baines ..... A47K 3/38
9,744,662 B1 * 8/2017 Henry ..... B25G 1/04
9,968,212 B1 * 5/2018 Lundmark ..... F16B 2/04
10,426,287 B1 * 10/2019 Tsai ..... A47H 1/022
10,436,235 B2 * 10/2019 Daniels ..... B25G 1/04
(Continued)

FOREIGN PATENT DOCUMENTS

CN 217743949 U * 11/2022 ..... A47H 1/022

*Primary Examiner* — Jennifer E. Novosad

(57) ABSTRACT

This disclosed invention relates to an adjustable shower curtain rod that includes a first rod with a cavity and a second rod that slides within this cavity for length adjustment. Further included are a pressure mechanism comprising positioning, locking, and extruding parts to securely adjust and fix the rod's length. Some embodiments include a friction part with an elastic deformation slot.

6 Claims, 8 Drawing Sheets

(56) References Cited

U.S. PATENT DOCUMENTS

| | | | | |
|---|---|---|---|---|
| 2008/0295240 | A1* | 12/2008 | Chang | A47K 3/38<br>4/610 |
| 2021/0033126 | A1* | 2/2021 | Henderson | F16B 7/1454 |
| 2021/0378433 | A1* | 12/2021 | Berman | A47H 1/022 |

* cited by examiner

RETRACTABLE SHOWER CURTAIN ROD AND ITS EXTENDABLE INSTALLATION METHOD

FIELD OF THE INVENTION

This application falls into the technical field of bathroom products, and particularly relates to a retractable shower curtain rod and its extendable installation method.

BACKGROUND

The existing shower curtain rods are usually fixed on the bathroom wall by drilling holes and nailing in the bathroom wall or using vacuum cups, so they are installed inconveniently and cannot adapt to the bathrooms of different sizes, and there exist some technical problems such as leaving installation marks on the wall after dismantling.

SUMMARY OF THE INVENTION

In view of this, this application provides a retractable shower curtain rod and its extendable installation method in order to solve the technical problems in the prior art.

To solve the technical problems, the retractable shower curtain rod provided in this application is:

A retractable shower curtain rod, wherein the retractable shower curtain rod comprises a first rod, a second rod and a pressure mechanism; the first rod is provided with a first cavity, and the second rod is assembled in the first cavity and slides in the first cavity to adjust the length of the retractable shower curtain rod; the pressure mechanism locks the length of the retractable shower curtain rod and has the first rod and the second rod extended on both sides to press on the bathroom wall.

Preferably, the pressure mechanism comprises a positioning part, a locking part and an extruding part; the positioning part can slide back and forth on the second rod to determine the locked position, the locking part can fix the positioning part on the second rod, and the extruding part has the first rod and the second rod extended on both sides by coordinating with the locking part to press on the bathroom wall.

Preferably, the positioning part is provided with a positioning hole, a locking screw hole and an extruding external thread; the locking part is a screw fastener, the positioning part is sleeved on the second rod through the positioning hole, and the locking part is assembled in the locking screw hole; fastening the locking part can help fix the positioning part on the second rod; loosening the locking part can help loosen the fixed connection between the positioning part and the second rod; the extruding part is provided with an extruding internal screw hole, and the structural dimensions of the extruding internal screw hole and the extruding external screw are matched with each other; the extruding part is assembled on the positioning part through screw matching, and exerts pressure on the first rod by rotating with the positioning part.

Preferably, the pressure mechanism further comprises a friction part, and the friction part is provided with a friction hole, an extruding position and an embedding position; the friction part is sleeved on the second rod through the friction hole and located between the first rod and the positioning part; when the extruding part exerts pressure on the extruding position, the embedding position can be embedded in the gap between the first rod and the second rod to increase the stability of the connection.

Preferably, the embedding position of the friction part is further provided with an elastic deformation slot, and the elastic deformation slot is used to generate elastic deformation when the embedding position is embedded between the first rod and the second rod.

Preferably, the second rod is further provided with a positioning guide slot or a positioning guide rib, and the positioning part is provided with a rod guide rib or a rod guide slot for matching with the positioning guide slot or the positioning guide rib.

Preferably, one end of the first rod used for contacting the wall is further provided with a first wall-pressing component, the first wall-pressing component comprises a first base plate, a first buffering part and a first connecting part, and the first base plate, the first buffering part and the first connecting part are connected with each other.

Preferably, one end of the second rod used for contacting the wall is further provided with a second wall-pressing component, the second wall-pressing comprises a second base plate, a second buffering part and a second connecting part, and the second base plate, the second buffering part and the second connecting part are connected with each other.

To solve the technical problems, the extendable installation method of the retractable shower curtain rod provided in this application is as follows:

The extendable installation method of the retractable shower curtain rod, wherein it adopts the retractable shower curtain rod according to any of the above technical solutions to realize the extendable installation in the bathrooms of different sizes; the length of the retractable shower curtain rod is adjusted by adjusting the assembly depth of the first rod in the second rod, the length of the retractable shower curtain rod is locked by the pressure mechanism, and the first rod and the second rod extend on both sides to press on the bathroom wall.

Preferably, that pressure mechanism comprises a positioning part, a locking part and an extruding part, and the extendable installation of the retractable shower curtain rod includes the following steps:

Adaptation step: Adjust the length of the retractable shower curtain rod by adjusting the assembly depth of the second rod in the first cavity of the first rod to adapt to the size of the bathroom;

Positioning step: Slide the positioning part on the second rod to a position close to the first rod and fix the positioning part on the second rod through a locking part;

Fixing step: Assemble the extruding part on the positioning part through screw-thread fit, and rotate the extruding part to make the extruding part exert pressure on the first rod to press on the bathroom wall.

Preferably, the pressure mechanism further comprises a friction part, and the friction part is provided with a friction hole, an extruding position and an embedding position; the friction part is sleeved on the second rod through the friction hole and located between the first rod and the positioning part; the fixing step adopts the following technical solution to press on the bathroom wall:

Rotate the extruding part to make the extruding part exert pressure on the extruding position of the friction part; when the extruding part exerts pressure on the extruding position, the embedding position can be embedded in the gap between the first rod and the second rod to increase the stability of the connection while the friction part extrudes the first rod.

Beneficial Technical Effects:

The retractable shower curtain rod and the extendable installation method, which is provided in this application, adopts the retractable connection between the first rod and the second rod and uses the pressure mechanism can adapt to the bathrooms of different sizes, avoid conventional operations like drilling holes and nailing in the wall, and have such technical effects as good applicability, convenient demounting and no traces.

The technical solutions and technical effects of this application are introduced in detail with reference to the following drawings and specific implementations.

MARKING INSTRUCTIONS

Figure 1:
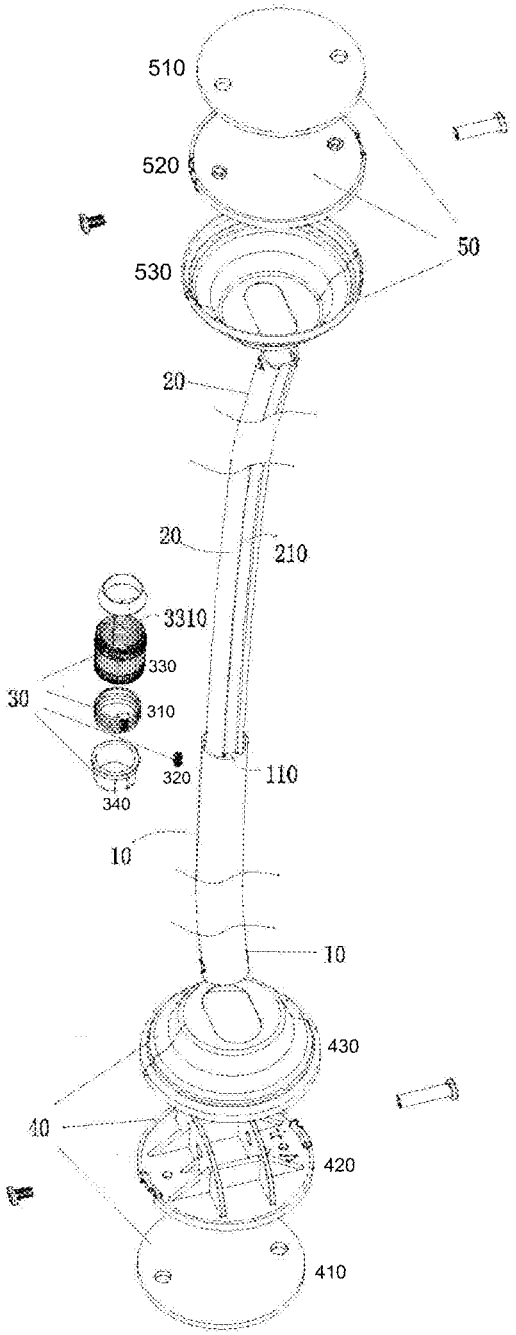
FIG. 1: Exploded diagram of the retractable shower curtain rod.

10—first rod, 20—second rod, 30—extendable installation structure, 40—first wall-pressing component, 50—second wall-pressing component;

110—first cavity, 120—positioning guide position;

210—positioning guide slot;

310—positioning part, 320—locking part, 330—extruding part, 340—friction part;

3110—positioning hole, 3120—locking screw hole, 3130—extruding external thread, 3140—positioning guide rib;

3310—extruding internal screw hole;

3410—friction hole, 3420—extruding position, 3430—embedding position, 3440—elastic deformation slot;

410—first base plate, 420—first buffering part, 430—first connecting part;

510—second base plate, 520—second buffering part, 530—second connecting part.

DETAILED DESCRIPTION

Referring to FIG. 1-8, the retractable shower curtain rod provided in this application comprises a first rod 10, a second rod 20 and a pressure mechanism 30. The first rod 10 and the second rod 20 are straight or curved tubular, and the diameter of the first rod 10 is relatively large, while the diameter of the second rod 20 is relatively small; the second rod 20 is assembled in the first cavity 110 inside the first rod 10, and slides in the first cavity 110 to adjust the length of the retractable shower curtain rod. When the assembly depth of the second rod 20 in the first rod 10 is deep, the length of the shower curtain rod will be short; when the assembly depth of the second rod 20 in the first rod 10 is shallow, the length of the shower curtain rod will be long.

The first rod 10 can be made of plastics, metal or wood, and the first rod 10 can be a round tube, a square tube or other tubular structures. The second rod 20 can be made of plastics, metal or wood, and the second rod 20 can be a tubular structure or a solid structure such as rod structure. As long as it can be assembled in the first cavity 110 of the first rod 10 and slide in the first cavity 110 (that is, adjust the assembly depth of the second rod 20 in the first cavity 110), the technical solutions of this application can be realized.

The pressure mechanism 30 locks the length of the retractable shower curtain rod and has the first rod 10 and the second rod 20 extended on both sides to press on the bathroom wall. The pressure mechanism 30 comprises a positioning part 310, a locking part 320 and an extruding part 330; the positioning part 310 can slide back and forth on the second rod 20 to determine the locked position, the locking part 320 can fix the positioning part 310 to the second rod 20, and the extruding part 330 has the first rod 10 and the second rod 20 extended on both sides by cooperating with the locking part 320 to press on the bathroom wall.

Figure 7:
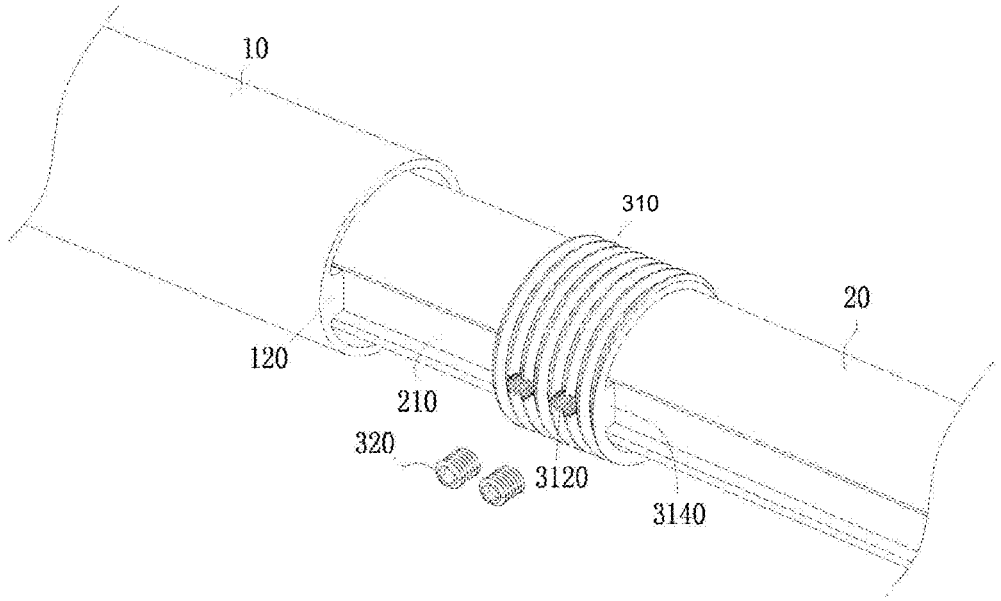
FIG. 7: Schematic diagram of the locking process of the positioning part.

Specifically, referring to FIG. 7, the positioning part 310 is provided with a positioning hole 3110, a locking screw hole 3120 and an extruding external thread 3130. The locking part 320 is a screw fastener (preferably a set screw), and the positioning hole 3110 is a through hole, and the positioning part 310 is sleeved on the second rod 20 through the positioning hole 3110 and slides back and forth on the second rod 20. The locking part 320 is assembled to the locking screw hole 3120. Fastening the locking part 320 can help fix the positioning part 310 on the second rod 20; loosening the locking part 320 can help loosen the fixed connection between the positioning part 310 and the second rod 20, and the locking part 320 can slide back and forth on the second rod 20 to adjust the fixed position of the positioning part 310.

Figure 8:
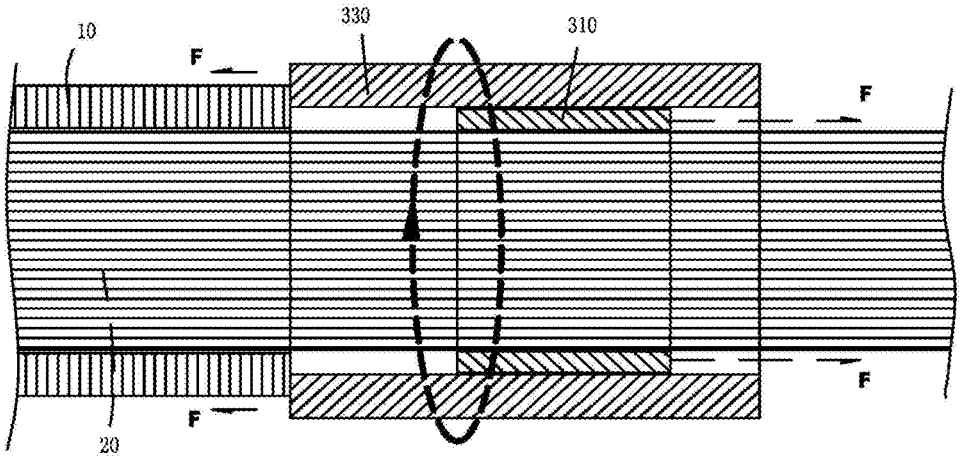
FIG. 8: Schematic diagram of the principle of the retractable shower curtain.

The extruding part 330 is provided with an extruding internal screw hole 3310, and the structural dimensions of the extruding internal screw hole 3310 and the extruding external screw hole 3130 are matched with each other; the extruding internal screw hole 3310 is a through hole, and the extruding part 330 is assembled on the positioning part 310 through screw-thread fit and exerts pressure on the first rod 10 by rotating with the positioning part 310. Specifically, when the positioning part 310 is fixed near the end of the first rod 10 and the extruding part 330 is screwed on the positioning part 310 in the direction of the first rod 10, the extruding part 330 will gradually contact the end of the first rod 10 and begin to exert pressure. Referring to FIG. 8, when the first rod 10 is under pressure from the extruding part 330, the second rod 20 is also under pressure from the positioning part 310 to have the first rod 10 and the second rod 20 gradually extended on both sides and then press against the bathroom wall. When the retractable shower curtain rod is installed, as the positioning part 310 and the extruding part 330 are connected through screw-thread fit, the retaining force of the screw thread can maintain the extended state of the shower curtain rod.

The screwing of the locking part 320 should be able to lock the connection between the positioning part 310 and the second rod 20, and should not affect the screw-thread fit between the extruding part 330 and the positioning part 310, or the screwing of the locking part 320 should not affect the rotation between the extruding part 330 and the positioning part 310, and it should be able to lock the connection between the positioning part 310 and the second rod 20. Referring to FIG. 1 and FIG. 7, set screw (headless stop screw) should be preferably used as the locking part 320 in this application, and the end of the set screw can be screwed into the locking screw hole 3120 to complete the locking of the positioning part 310 without affecting the threaded fit between the extruding part 330 and the positioning part 310.

In the modified embodiments of this application, the pressure mechanism 30 can further integrate a friction part 340, and the friction part 340 is set between the first rod 10 and the positioning part 310; the pressure from the extruding part 330 is firstly transmitted to the friction part 340, and then transmitted to the first rod 10 through the friction part 340. Specifically, the friction part 340 can adopt the structure in FIG. 3 to increase the overall stability and mechanical strength of the shower curtain rod.

The friction part 340 is provided with a friction hole 3410, an extruding position 3420, an embedding position 3430 and an elastic deformation slot 3440; the friction hole 3410, the extruding position 3420, the embedding position 3430 and the elastic deformation slot 3440 are formed as a whole. The friction hole 3410 is a through hole. The size of the extruding position 3420 is larger than that of the embedding position 3430, and the elastic deformation slot 3440 is set on the embedding position 3430. The friction part 340 is sleeved on the second rod 20 through the friction hole 3410 and located between the first rod 10 and the positioning part 310. When the extruding part 330 exerts pressure on the extruding position 3420, the embedding position 3430 can be fully or partially embedded in the gap between the first rod 10 and the second rod 20 to increase the stability of the connection between the first rod 10 and the second rod 20. When the embedding position 3430 is fully or partially embedded in the gap between the first rod 10 and the second rod 20, the embedding position 3430 and/or the extruding position 3420 will exert pressure on the first rod 10, and the elastic deformation slot 3440 will also deform to adapt to the compression. The friction part 340 can be made of metal, wood or plastics, and it is preferably plastic.

Figure 2:
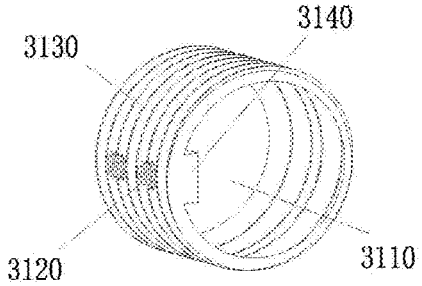
FIG. 2: Structural diagram of the positioning part in FIG. 1.
Figure 3:
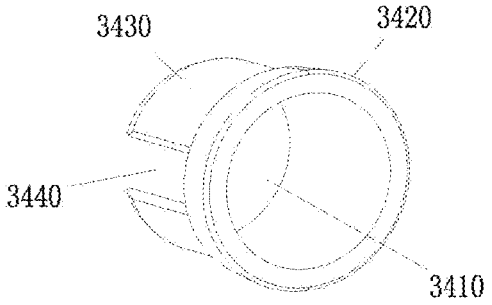
FIG. 3: Structural diagram of the friction part in FIG. 1.
Figure 4:
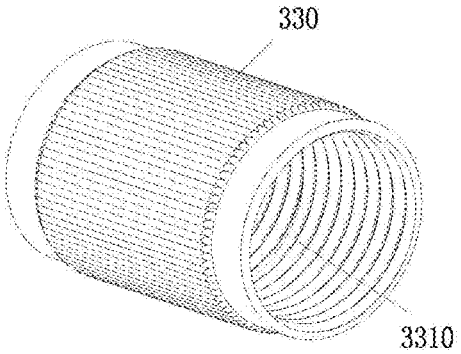
FIG. 4: Structural diagram of the extruding part in FIG. 1.
Figure 5:
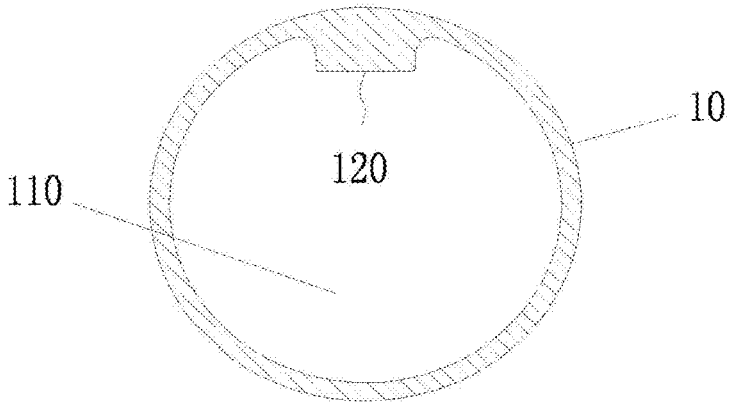
FIG. 5: Schematic cross section of the first rod in FIG. 1.
Figure 6:
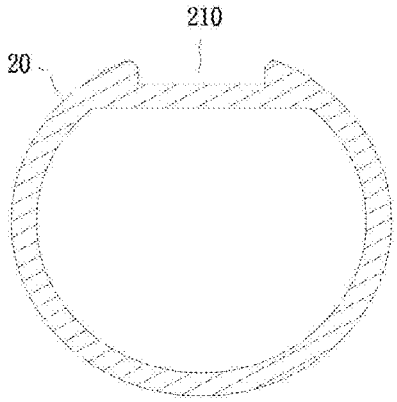
FIG. 6: Schematic cross section of the second rod in FIG. 1.

In another modified embodiment of this application, in order to facilitate the sliding and locking of the positioning part 310 on the second rod 20, the second rod 20 and the positioning part 310 can be further provided with mutually matched guide structures respectively. Referring to FIGS. 1 and 2, the guide structures are preferably the positioning guide slot 210 provided on the second rod 20 and the rod guide rib 3140 provided on the positioning part 310. The positioning part 310 is assembled through the coordination between the positioning guide slot 210 and the rod guide rib 3140; the adjustment during positioning is very rapid and accurate, and the locking is very efficient and accurate. Similarly, in order to strengthen the connection and adjustment between the first rod 10 and the second rod 20, the first rod 10 can be further provided with a structure similar to the rod guide rib 3140 of the positioning part 310, such as the positioning guide position 120 in FIG. 7.

In the modified embodiments of this application, in order to strengthen the stability between the first rod 10, the second rod 20 and the bathroom wall, the first wall-pressing component 40 and the second wall-pressing component 50 can be provided respectively at the ends of the first rod 10 and the second rod 20. Referring to FIG. 1, the first wall-pressing component 40 comprises a first base plate 410, a first buffering part 420 and a first connecting part 430, and the first base plate 410, the first buffering part 420 and the first connecting part 430 are connected with each other. They can be connected through a buckle structure or a screw fastener. The first connecting part 430 is used to install the first rod 10, and the first base plate 410 is used to attach to the bathroom wall. The second wall-pressing component 50 comprises a second base plate 510, a second buffering part 520 and a second connecting part 530 are connected with each other. They can be connected through a buckle structure or a screw fastener. The second connecting part 530 is used to install the second rod 20, and the second base plate 510 is used to attach to the bathroom wall.

Implementation principle: During installation, the assembly depth of the second rod 20 in the first cavity 110 is firstly adjusted to preliminarily adapt to the size of the bathroom. After the adjustment, the positioning part 310 on the second rod 20 is slid near the end of the first rod 10, and then the locking part 320 is screwed into the locking screw hole 3120 to fix the positioning part 310 on the second rod 20. After the positioning part 310 is fixed, the extruding part 330 is assembled on the positioning part 310 through screw-thread fit, and the extruding part 330 is gradually rotated to make it approach the first rod 10 to generate an extruding force. After the first rod 10 is under pressure from the extruding part 330, the second rod 20 is also under pressure from the positioning part 310 to have the first rod 10 and the second rod 20 gradually extended on both sides and pressed against the bathroom wall. When the retractable shower curtain rod is installed, as the positioning part 310 and the extruding part 330 are connected through screw-thread fit, the retaining force of the screw thread can maintain the extended state of the shower curtain rod. When the shower curtain rod needs to be replaced, rotate the extruding part 330 and move forward away from the first rod 10, and then adjust the assembly depth of the second rod 20 in the first cavity body 10 to smoothly disassemble the shower curtain rod. Therefore, the retractable shower curtain rod provided in this application can adapt to the bathrooms of different sizes, avoid drilling holes and nailing in the wall, and have such technical effects as good applicability, convenient demounting and no traces.

From the above description, this application further provides a extendable installation method for the shower curtain rod, which adopts the retractable shower curtain rod provided in this application to realize extendable installation in the bathrooms of different sizes; in practice, the length of the retractable shower curtain rod is adjusted by adjusting the assembly depth of the first rod 10 in the second rod 20, the length of the retractable shower curtain rod is locked by the pressure mechanism 30, and the first rod 10 and the second rod 20 extend on both sides to press on the bathroom wall.

Furthermore, the extendable installation method of the retractable shower curtain rod adopts the following steps to realize the extendable installation of the shower curtain rod:

- Adjusting step: Adjust the length of the retractable shower curtain rod by adjusting the assembly depth of the second rod 20 in the first cavity 110 of the first rod 10 to adapt to the size of the bathroom;
- Positioning step: Slide the positioning part 310 on the second rod 20 to a position close to the first rod 10 and fix the positioning part 310 on the second rod 20 by the locking part 320;
- Fixing step: Assemble the extruding part 330 on the positioning part 310 through screw-thread fit, and rotate the extruding part 330 to make the extruding part 330 exert pressure on the first rod 10 to press on the bathroom wall.

In a preferred embodiment of the extendable installation method of the retractable shower curtain rod, the pressure mechanism further comprises a friction part 340, and the friction part 340 is provided with a friction hole 3410, an extruding position 3420 and an embedding position 3430; the friction part 340 is sleeved on the second rod 20 through the friction hole 3410 and located between the first rod 10 and the positioning part 310; the above the fixing step adopts the following technical solution to press on the bathroom wall:

Rotate the extruding part 310 to make the extruding part exert pressure on the extruding position of the friction part 340; when the extruding part 310 exerts pressure on the extruding position 3420, the embedding position 3430 can be embedded in the gap between the first rod 10 and the second rod 20 to increase the stability of the connection while the friction part 340 extrudes the first rod 10.

The technical solutions and technical effects of this application are described in detail with reference to the drawings and specific embodiments. It should be noted that the specific embodiments disclosed in the specification are only the preferred embodiments in this application, and the technicians in the field can also develop other embodiments on this basis; any simple variations and equivalent replacement that are not separated from the innovative ideas of this application are covered in this application and included the protection scope of the present patent.

What is claimed is:

1. A retractable shower curtain rod, comprising:

a first rod (10), a second rod (20) and a pressure mechanism (30); wherein the first rod (10) is provided with a first cavity (110), the second rod (20) is assembled in the first cavity (110) and slides therein to adjust a length of the retractable shower curtain rod;

the pressure mechanism (30) is configured to lock the length of the retractable shower curtain rod and make the first rod (10) and the second rod (20) extend to press two ends of the retractable shower curtain rod on the bathroom wall;

wherein the pressure mechanism (30) comprises a positioning part (310), a locking part (320) and an extruding part (330);

the positioning part (310) is configured to slide back and forth on the second rod (20) to determine the locked position, the locking part (320) is configured to fix the positioning part (310) to the second rod (20), and the extruding part (330) is configured to coordinate with the locking part (320) to make the first rod (10) and the second rod (20) extend, so as to press the two ends of the retractable shower curtain rod on the bathroom wall;

wherein the positioning part (310) is provided with a positioning hole (3110), a locking screw hole (3120) and an extruding external thread (3130);

the positioning part (310) is sleeved on the second rod (20) through the positioning hole (3110), the locking part (320) is a screw fastener assembled in the locking screw hole (3120), and the locking part (320) is configured to fix the positioning part (310) to the second rod (20) and loosen a fixed connection between the positioning part (310) and the second rod (20);

the extruding part (330) is provided with an extruding internal screw hole (3130) matched with the extruding external screw (3130), and the extruding part (330) is assembled on the positioning part (310) through screw threads and exerts pressure on the first rod (10) by rotating with the positioning part (310).

2. The retractable shower curtain rod according to claim 1, wherein the pressure mechanism (30) further comprises a friction part (340), and the friction part (340) is provided with a friction hole (3410), an extruding position (3420) and an embedding position (3430);

the friction part (340) is configured to sleeve on the second rod (20) through the friction hole (3410) and locate between the first rod (10) and the positioning part (310);

when the extruding part (330) exerts pressure on the extruding position (3420), the embedding position (3430) is configured to embed between the first rod (10) and the second rod (20) to increase the stability of the connection.

3. The retractable shower curtain rod according to claim 2, wherein the embedding position (3430) of the friction part (340) is further provided with an elastic deformation slot (3440), and the elastic deformation slot (3440) is configured to generate elastic deformation when the embedding position (3430) is embedded between the first rod (10) and the second rod (20).

4. The retractable shower curtain rod according to claim 1, wherein the second rod (20) is provided with a positioning guide slot (210) or a positioning guide rib for matching with a rod guide rib (3140) or a rod guide slot provided on the positioning part (310).

5. The retractable shower curtain rod according to claim 1, wherein one end of the first rod (10) configured to contact the wall is provided with a first wall-pressing component (40), the first wall-pressing component (40) comprises a first base plate (410), a first buffering part (420) and a first connecting part (430), and the first base plate (410), the first buffering part (420) and the first connecting part (430) are connected with each other.

6. The retractable shower curtain rod according to claim 1, wherein one end of the second rod (20) configured to contact the wall is provided with a second wall-pressing component (50), the second wall-pressing (50) comprises a second base plate (510), a second buffering part (520) and a second connecting part (530), and the second base plate (510), the second buffering part (520) and the second connecting part (430) are connected with each other.

* * * * *